US006362458B1

(12) United States Patent
Sargunam et al.

(10) Patent No.: US 6,362,458 B1
(45) Date of Patent: Mar. 26, 2002

(54) FOOD GRILLING SYSTEM FOR OVEN CAVITY WITH BYPRODUCT REMOVAL

(75) Inventors: Isaac P. Sargunam; Robert H. Williams, Jr., both of Cleveland; Richard J. Arntz, deceased, late of Georgetown, all of TN (US), by Edeltraud Arntz, Legal Representative

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/771,667

(22) Filed: Jan. 30, 2001

(51) Int. Cl.[7] ..... A21B 1/14; A21B 3/04

(52) U.S. Cl. ..... 219/396; 219/397; 219/398; 219/400

(58) Field of Search ..... 219/395–398, 219/400, 403; 126/21 A, 21 R, 332, 337 R, 339; 99/340, 390, 444–446

(56) References Cited

U.S. PATENT DOCUMENTS

| | | | | | |
|---|---|---|---|---|---|
| 2,846,557 | A | | 8/1958 | Schulze et al. | |
| 2,851,575 | A | | 9/1958 | Walston et al. | |
| 2,922,018 | A | | 1/1960 | Walkoe | |
| 3,270,660 | A | | 9/1966 | Filipak | |
| 3,358,120 | A | | 12/1967 | Schibley | |
| 3,470,353 | A | | 9/1969 | Holtkamp | |
| 3,470,354 | A | | 9/1969 | Tilus | |
| 3,548,154 | A | | 12/1970 | Christiansson | |
| 3,745,912 | A | * | 7/1973 | Field | 99/446 |
| 3,789,748 | A | * | 2/1974 | Rappoport et al. | 99/340 |
| 3,797,375 | A | | 3/1974 | Cerola | |
| 3,962,561 | A | | 6/1976 | Maitenaz | |
| 4,238,669 | A | * | 12/1980 | Huntley | 219/398 |
| 4,355,570 | A | * | 10/1982 | Martin et al. | 99/446 |
| 4,476,848 | A | * | 10/1984 | Protas | 99/340 |
| 4,481,404 | A | | 11/1984 | Thomas et al. | |
| 4,517,886 | A | | 5/1985 | Bales | |
| 4,736,729 | A | | 4/1988 | Beach | |
| 4,780,597 | A | | 10/1988 | Linhart et al. | |
| 5,038,747 | A | | 8/1991 | Tsuchiya et al. | |
| 5,272,317 | A | * | 12/1993 | Ryu | 219/403 |
| 5,308,956 | A | * | 5/1994 | Halters et al. | 219/400 |
| 5,363,748 | A | | 11/1994 | Boehm et al. | |
| 5,512,737 | A | * | 4/1996 | Miklos | 219/771 |
| 5,719,377 | A | | 2/1998 | Giebel et al. | |
| 5,938,959 | A | * | 8/1999 | Wang | 219/395 |
| 6,087,634 | A | * | 7/2000 | Cook et al. | 219/396 |
| 6,191,389 | B1 | * | 2/2001 | Rickert, Jr. | 219/400 |
| 6,259,063 | B1 | * | 7/2001 | Lintner et al. | 219/400 |
| 6,260,478 | B1 | * | 7/2001 | Harneit | 99/446 |

* cited by examiner

*Primary Examiner*—Joseph Pelham
(74) *Attorney, Agent, or Firm*—Diederiks & Whitelaw, PLC

(57) ABSTRACT

A grilling system for an oven includes a removable grilling platform defined by a food supporting rack, a basin, and a heating element positioned between the rack and the basin. The basin includes a bottom surface which is sloped in order to direct liquid byproducts of the grilling operation either into a collection container or to an auxiliary heating element used to vaporize the liquid byproducts. An exhaust system is provided to purge the oven cavity of gaseous and airborne byproducts.

28 Claims, 4 Drawing Sheets

FOOD GRILLING SYSTEM FOR OVEN CAVITY WITH BYPRODUCT REMOVAL

BACKGROUND OF THE INVENTION

1. Field of the Invention

The present invention relates to a cooking appliance including an oven cavity which can be used to grill food items. Specifically, the oven of the invention has a removable grilling unit which directs any grease or the like that drips off of the food items to a specialized heating element for vaporization or, optionally, into a jar for later removal. Additionally, the oven of the invention has been modified to utilize a downdraft system to rid the oven cavity of byproducts generated during grilling.

2. Discussion of the Prior Art

Modern home ovens are often equipped with two heating elements and a series of rack supports at varying levels. The first heating element, located at the bottom of the oven cavity, is traditionally used as a baking element. Baking is accomplished by heating an oven cavity and allowing the heated air to envelop the food being cooked. Because baking can optionally utilize convection heating, fans are sometimes provided to circulate the air inside the oven cavity. The second element in a home oven is the broiling element. Broiling is accomplished through radiant heating by energizing a heating element in close proximity to and above the food item. Because the broil heating element is located at the top of the oven cavity, broiling often requires that the food supporting rack be repositioned so that the food items can be close to the upper heating element.

Grilling, while somewhat similar to broiling, is generally not provided for in traditional ovens. Grilling is essentially accomplished by placing a heating element in close proximity to and below the food item, such that the desired cooking operation is performed primarily utilizing radiation. Home ovens are simply not designed with rack supports at the bottom of the oven cavity, i.e. close to the baking element to allow for grilling. However, at least U.S. Pat. No. 3,358,120 is directed to and describes an oven insert which is designed to convert a home oven to a grilling unit. Specifically, a removable heating element and bottomless shell are included. The shell supports an additional rack onto which a food item to be grilled is placed. The side walls of the shell also protect the inside of the oven from the liquid byproducts, such as fats, oil, and grease, generated during the grilling operation. When liquid byproducts are developed, they will usually drip downward toward the heating element. If the byproducts land on the heating element, the high temperature of the heating element prevents the byproduct from sticking. All of the byproduct then drips downward through the shell. A drip pan is positioned on a lower rack to catch the falling fats, oil, grease etc. But the shell only protects the inside of the oven from the portion of the liquid byproducts which travel downward directly into the drip pan. Of course, the consumer must eventually clean the byproduct collected in the pan.

Another major problem with grilling in an oven cavity is the fact that a considerable amount of gaseous byproducts, such as smoke, can be developed. Placing the heating element so close to the bottom of the food item will generate a significant amount of smoke and, if attempted in a traditional oven, would fill the oven and eventually the kitchen with smoke. Although convectional ovens generally include air circulation systems, they are not designed to effectively accommodate grilling.

Based on the above, there exists a need in the art of cooking for a system which will not only enable an oven to be effectively used for grilling of food items but which addresses the elimination of byproducts inherently generated during a grilling operation.

SUMMARY OF THE INVENTION

The present invention is directed to a household cooking appliance which has an oven cavity adapted for grilling. The potential problems associated with byproduct generation are addressed by including either a separate burner for combusting the fats, oil, grease, etc. and/or a removeable jar for catching any liquid byproducts. The problems associated with smoke are eliminated by incorporating a downdraft exhaust system, similar to that commonly used in connection with stove-top cooking, in the oven cavity.

Specifically, a grilling platform is provided which includes four main parts. The first is a grilling rack onto which the food item to be grilled is placed. An auxiliary heating or grilling element is included which has been specially designed to fit into a receptacle in the oven wall for easy installation and removal. A basin surrounds the bottom and sides of the grilling element, as the grilling rack sits upon an upper ledge portion of the basin. The shape of the basin is such that the rack is in close proximity to the grilling element and hence, the food item(s), when properly installed.

The grilling platform additionally includes a grease jar which collects liquid byproducts develops during grilling. The bottom surface of the basin is sloped to funnel any collected fats, oil, grease or the like to one side of the basin. The grease jar is arranged at a low portion of the basin to catch the fats, oil, and grease from the basin itself. The grease jar extends below the basin to hold the byproducts until the jar is removed and either cleaned or replaced. The grilling platform is also provided with special rack structure which mates with a rack support in the oven cavity to hold the grilling platform, including the grilling element, in place.

In another embodiment, the grease jar is replaced with a spout formed in the lower surface of the basin. As the liquid byproducts drip off the food into the basin, they are directed toward the spout. Positioned directly below the spout is an additional heating element which is used to combust these liquid byproducts. Generally, when the byproducts are heated to an elevated temperature, smoke is produced. Because the liquid byproducts are immediately combusted, the production of gaseous byproducts, i.e. smoke and other airborne byproducts, is minimized.

However, the oven of the invention also includes a gaseous byproduct elimination system which is designed to handle the smoke and the like generated during grilling. More specifically, an exhaust plenum is provided, preferably near the bottom of the oven cavity. A fan is located outside the oven cavity and, when activated, draws air from inside the oven, through the plenum and out of the oven. With this overall arrangement, the oven cavity can be effectively used for grilling purposes.

Additional objects, features and advantages of the invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
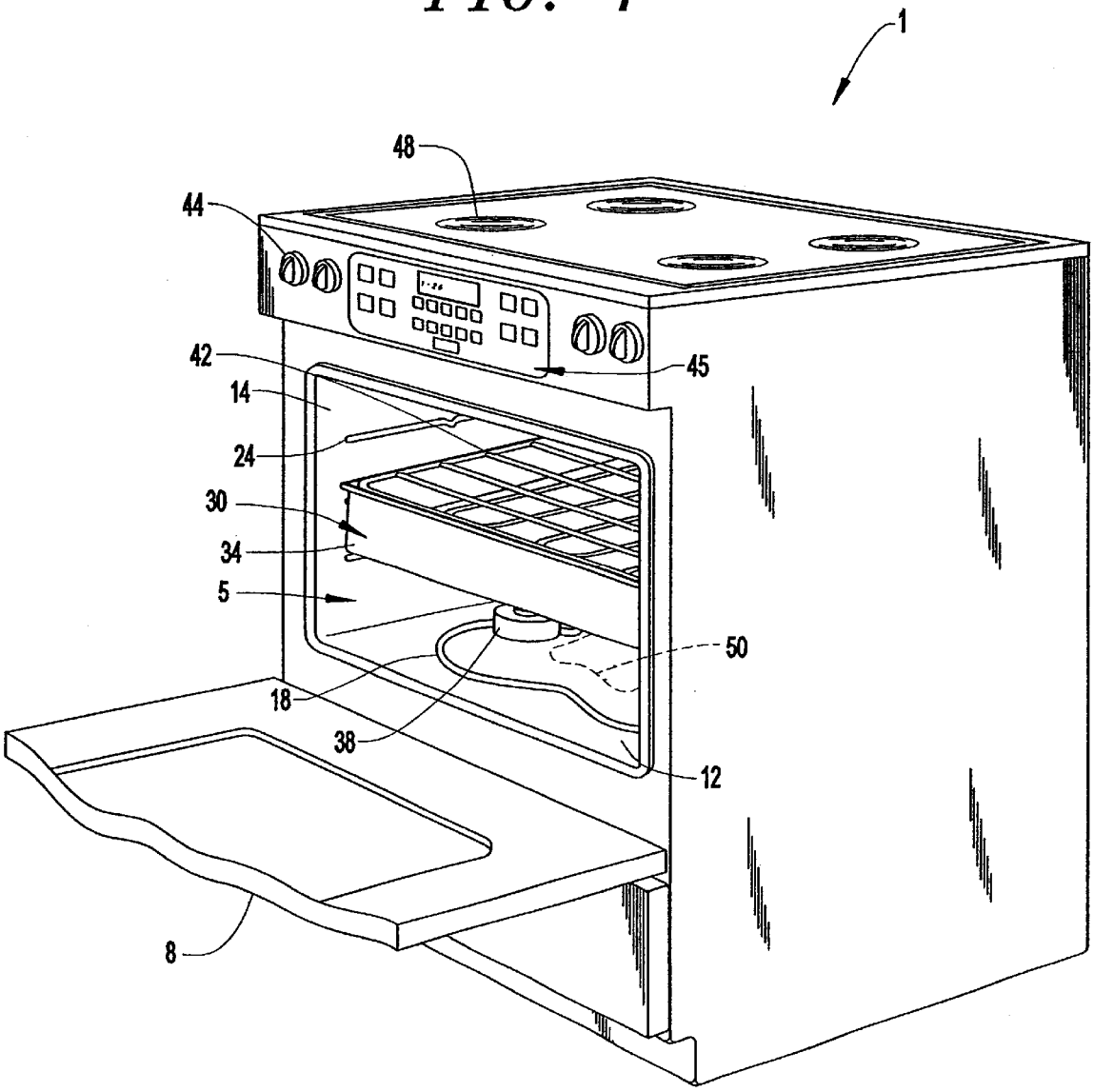
FIG. 1 is a perspective view a first embodiment of an oven constructed in accordance with the invention.
Figure 4:
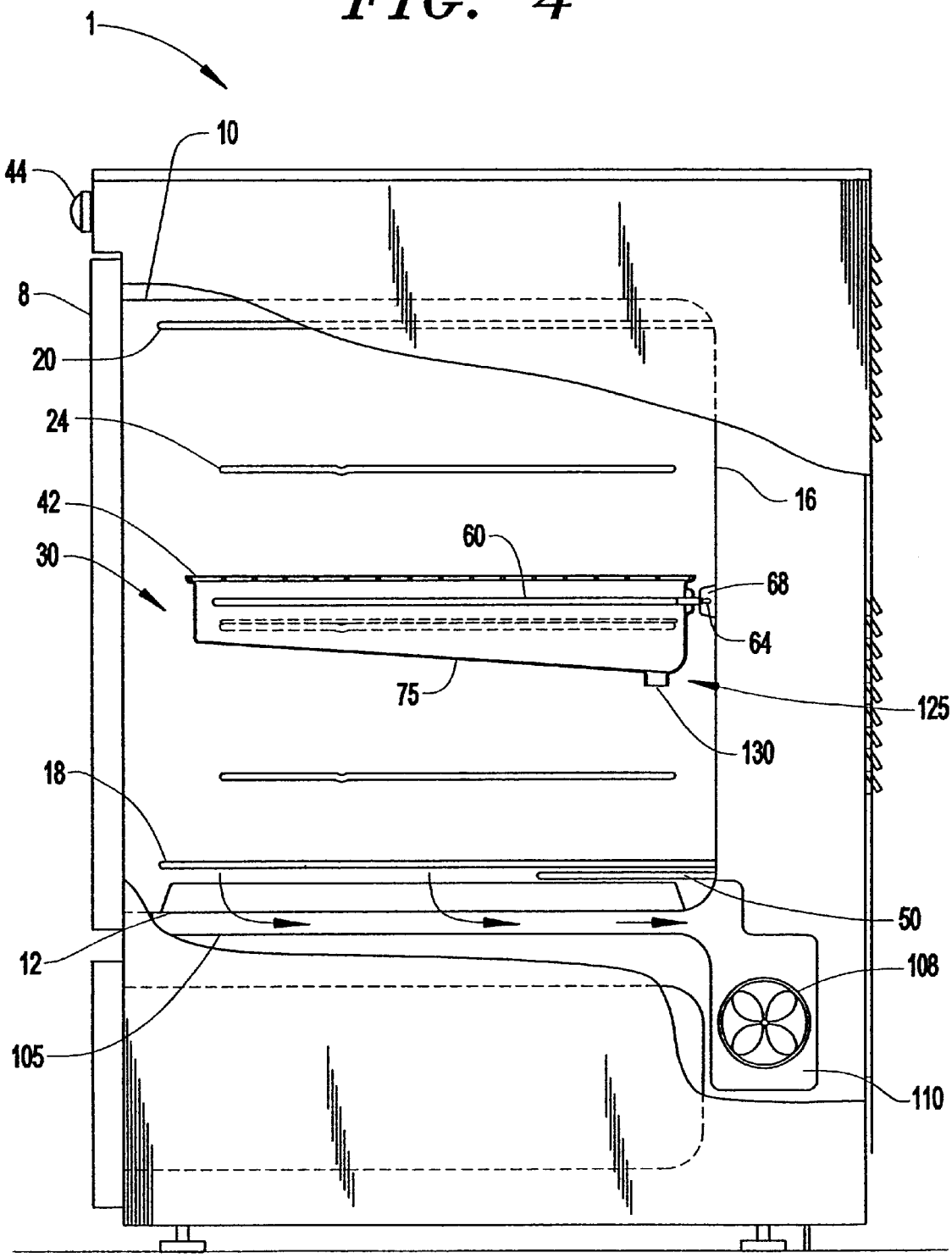
FIG. 4 is a cross-section side view of a modified form of the oven of FIG. 1.

FIG. 1 depicts an oven 1 constructed in accordance with a first embodiment of the invention. Specifically, oven 1 includes an oven cavity 5 therein which can be closed by a door 8 that is shown in the open position. Briefly, oven cavity 5 is constructed of a top 10, a bottom 12, two spaced apart side walls 14, and a back wall 16 as best shown in FIG. 4. A bake element 18 is provided near, but not abutting, bottom 12 of oven cavity 5. Similarly, a broil element 20 is provided near, but not abutting, top 10 of oven cavity 5. Side walls 14 are formed with respective, vertically spaced pairs of rack supports 24, with each pair of rack supports 24 extending in a substantially horizontal plane. FIG. 1 depicts two sets of rack supports 24 inside oven cavity 5, but it is contemplated that additional pairs of rack supports 24 could be provided.

FIG. 1 illustrates a grilling platform 30 provided upon a pair of rack supports 24 in accordance with the invention. The visible face of grilling platform 30, as shown in FIG. 1, constitutes part of a basin 34. Extending below basin 34, but spaced from bottom 12 of oven cavity 5, is a byproduct collection container or jar 38. Sitting atop basin 34 is a grilling rack 42. More specifically, basin 34 is formed with one or more ledge portions 43 upon which grilling rack 42 is positioned. Grilling rack 42 is essentially constituted by a metallic lattice in the shape of a grid. Also provided on oven 1 are a series of burner knobs 44, as well as a central display and control unit 45 which are utilized to direct power to bake element 18, broil element 20, grilling platform 30 as discussed more fully below and burners or heating elements 48 located on top of oven 1. FIG. 1 also illustrates, adjacent bottom 12 of oven cavity 5, a combusting element 50 (shown in phantom). The combusting element 50 is preferably used with the second embodiment of the invention, as will be described fully below.

Figure 2:
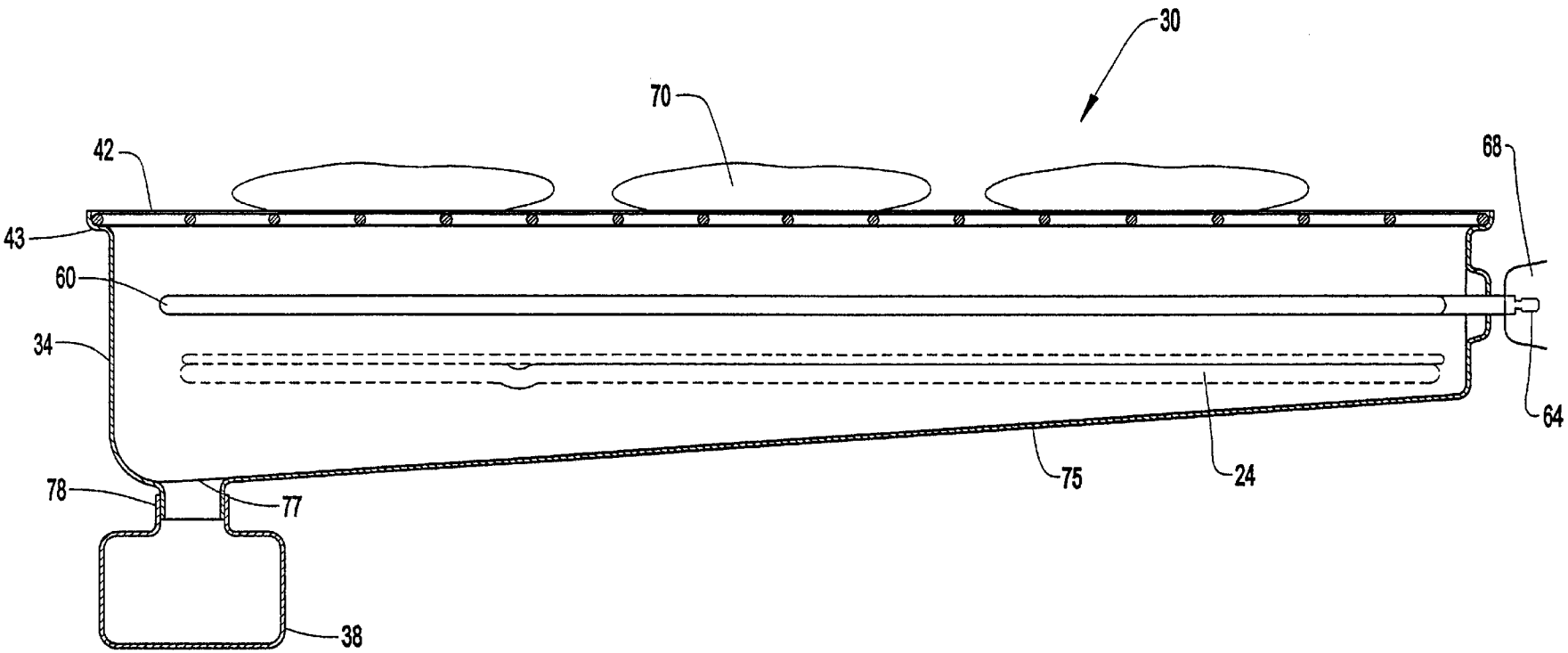
FIG. 2 is a cross-section side view of the grilling platform utilized in the oven of FIG. 1.

FIG. 2 depicts a side view of grilling platform 30. Specifically, grilling platform 30 includes basin 34, jar 38, grilling rack 42, and a grilling element 60. Grilling element 60 is positioned inside basin 34, but preferably does not directly touch any of the surfaces of basin 34. Grilling element 42 includes terminal connectors or a plug 64 which fits into a specially designed electric receptacle 68 formed in the back wall 16 of oven cavity 5. Although grilling element 60 is shown installed inside receptacle 68, it is intended that grilling element 60 can be readily inserted into and removed from receptacle 68 when the grilling platform 30 is respectively slid in and out of oven cavity 5. Shown placed on top of basin 34 is grilling rack 42. The construction of basin 34 and arrangement of grilling element 60 therein are such that when food items 70, such as hamburger patties, are placed on grilling rack 42, the food items 70 are close enough to grilling element 60 to permit grilling.

Additionally, basin 34 includes a sloped bottom surface 75, below food items 70, grilling rack 42, and grilling element 60. As shown in FIG. 2, sloped surface 75 of basin 34 begins closest to grilling rack 42 near plug 64, and slopes away from grilling rack 42 along substantially the entire length of basin 34. Jar 38 is attached to basin 34 where sloped surface 75 forms the lowest part of basin 34. More specifically, sloped surface 75 forms a drain 77, which is essentially an aperture through sloped surface 75. Annularly disposed about drain 77 is a neck 78 of jar 38. Jar 38 is preferably, removably attached to basin 34 with cooperating threaded screws, but may be connected by any commensurate method.

Figure 3:
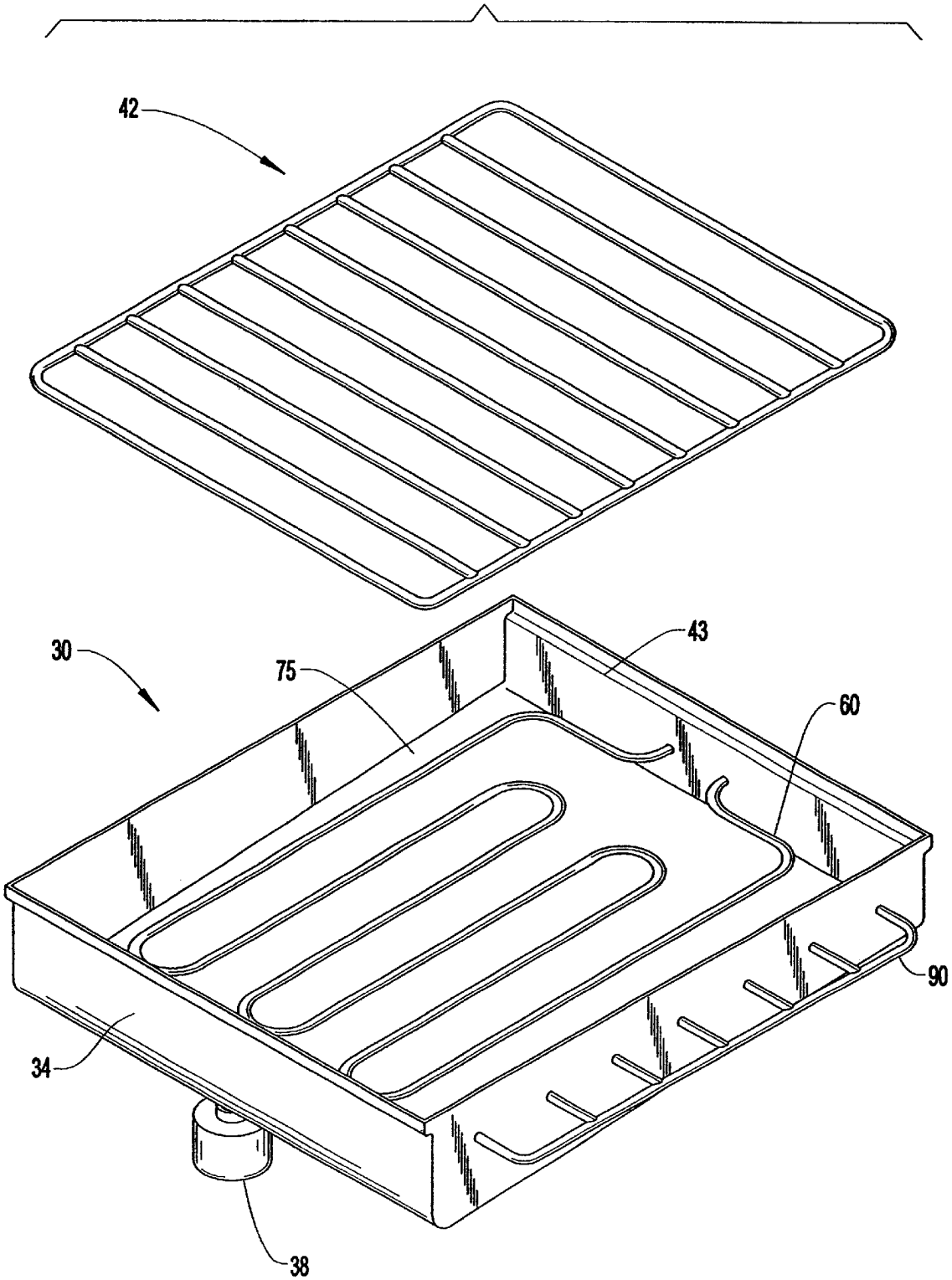
FIG. 3 is an exploded perspective view of the grilling platform of the FIG. 2.

FIG. 3 shows an exploded view of grilling platform 30 of the first embodiment of the invention. Specifically, in a manner analogous to a conventional oven rack, grilling rack 42 is constituted by a series of parallel rails attached to at least one peripheral rail. Although grilling rack 42 is shown in the traditional rectangular grid shape, grilling rack 42 may take various configurations, as long as it functions to support food items 70. Basin 34 preferably includes front and rear, transverse ledge portions 43. As indicated above, ledge portions 43 are designed to receive grilling rack 42 and to prevent movement during use, as well as allow for easy removal of rack 42 as desired.

Grilling element 60 is shown to take a serpentine configuration in the bottom of the basin 34. Although, just as with grilling rack 42, grilling element 60 is preferably of a known construction, such as a sheathed resistance-type heating element, any design which would allow for even grilling of food items 70 would suffice. Grilling element 60 is shown protruding through basin 34 where it terminates in plug 64. Disposed laterally about both sides of basin 34 are platform rails 90. It is platform rails 90 which interact with rack supports 24 on side walls 14 of oven cavity 5 to support grilling platform 30. Again, platform rails 90 simply slide atop a selected pair of rack supports 24.

FIG. 4 depicts an additional aspect of the invention, particularly an exhaust system of oven 1 which includes an exhaust plenum 105 arranged in bottom 12 of oven cavity 5. A fan 108 is used to create the downdrafts necessary to purge oven cavity 5 of any gaseous or airborne byproducts developed during a cooking operation through an outlet 110.

FIG. 4 also illustrates a second embodiment of the invention wherein jar 38 of the first embodiment has been replaced by a tapered, funnel section generally indicated at 125. Funnel section 125 terminates in a spout 130. In this embodiment, surface 75 of basin 34 slopes toward back 16 of oven cavity instead of toward door 8. Positioned in the area directly below spout 130 is combusting element 50. As indicated above, combusting element 50 lies along bottom 12 of oven cavity 5 in proximity to bake element 18. As shown in FIG. 1, combusting element 50 preferably lies inside the perimeter of bake element 18. In essence, combusting element 50 constitutes an additional electric heating element.

In order to use grilling platform 30 of the invention, it is first necessary to insert grilling platform 30 into oven cavity 5. The platform rails 90 are slid along rack supports 24 so that plug 64 of grilling element 60 extends into receptacle 68 in back wall 16 of oven cavity 5. At this time, oven 1 is ready for preheating. By manipulating the correct button of control unit 45, grilling element 60 becomes energized. Another button of controls 45 can be used to energize fan 108 and separately begin downdraft circulation, or fan 108 could simply be automatically activated upon operation of grilling element 60.

As the food items 70 are grilled, fats, oil, and grease will be generated and drip down into basin 34. Because of the configuration of basin 34, including sloped surface 75, the liquid byproducts will be directed into jar 38, in accordance with the first disclosed embodiment, where they are stored for later disposal. The downdraft current created by fan 108 draws in any emanating smoke into the exhaust plenum 105 to outlet 110. In accordance with the second embodiment of the invention, the liquid byproducts created by grilling the food items 70 drip down through grilling rack 42 into basin 34 and are directed along sloped surface 75 toward funnel section 125. Because funnel section 125 terminates in spout 130, the liquid byproducts drop to bottom 12 of oven cavity 5, within the confines of combusting element 50, and are rapidly cooked which generates gaseous byproducts, i.e., smoke and other airborne byproducts, which, in turn, are removed via the downdraft current.

At this point, it should be noted that combusting element 50 is not essential to the second embodiment of the invention. For instance, it is possible to eliminate combusting element 50 and utilize bake element 18 to vaporize the fats, oil, and/or grease. In such a design, bake element 18 can be energized at a lower wattage, and thus a relatively low temperature, such that it performs a corresponding function to combusting element 50. Although, in either embodiment, grilling platform 30 may be used without the downdraft system in operation, this is not preferable as a considerable amount of smoke can be generated. A smoke detecting arrangement could even be employed to control the operation of fan 108. Although spout 130 and combusting element 50 are shown near back 16 of oven cavity 5, this location is not controlling. However, spout 130 is preferably, directly above combusting element 50.

Although described with reference to preferred embodiments, it should readily understood that various changes and/or modifications could be made to the invention without departing from the spirit thereof. For instance, the vertical position of the grilling platform need not be in the center of the oven cavity. Additionally, the various heating elements could be constituted by gas burner elements. Also, the oven could take the form of a wall oven instead of a range as depicted. It should be realized that the exhaust plenum could be relocated, such as in the back, side or even top of the oven cavity. In fact, a more conventional exhaust arrangement could be employed wherein an upper downdraft is provided for use in connection with the upper heating elements and the oven cavity exhausts through one or more of the heating elements such that the upper downdraft is used to indirectly exhaust fumes from the oven cavity. Therefore, a multi-functioning downdraft system would be provided. Furthermore, it is contemplated to have the byproduct collecting jar located beneath the bottom of the oven cavity, with the bottom being sloped to a hole which leads to the jar. In either case, the jar, unless disposable, would preferably be removed prior to performing any self-cleaning cycle within the oven cavity. However, such a self-cleaning cycle could be advantageously used to clean the remainder of the grilling system. In any event, the invention is only intended to be limited by the scope of the following claims.

We claim:

1. In a cooking appliance including an oven cavity having an open frontal portion, a door for selectively sealing the open frontal portion, at least one heating element disposed adjacent a bottom portion of said oven cavity and controls for regulating an activation state of said heating element, a combination grilling and byproduct removal system comprising:

a grilling platform mounted within said oven cavity, said grilling platform including a rack for supporting food items to be grilled, a basin arranged below the rack and adapted to catch liquid byproducts generated during grilling, and an additional heating element extending between at least a lower portion of the basin and the rack, said additional heating element being adapted to be operated to grill food items on the rack; and an exhaust system having an inlet opening into the oven cavity and an outlet leading from the oven cavity, said exhaust system including a fan for drawing grilling byproducts out of the oven cavity.

2. The combination grilling and byproduct removal system according to claim 1, wherein the rack is directly supported by the basin.

3. The combination grilling and byproduct removal system according to claim 2, wherein the basin is formed with at least one upper peripheral ledge portion, said rack being positioned upon said ledge portion.

4. The combination grilling and byproduct removal system according to claim 1, wherein said basin includes a bottom surface which slopes relative to a horizontal.

5. The combination grilling and byproduct removal system according to claim 4, wherein the bottom surface of the basin slopes downwardly from a rear portion of the basin towards a front portion of the basin.

6. The combination grilling and byproduct removal system according to claim 5, further comprising: a liquid byproduct collection container attached to the bottom surface of the basin.

7. The combination grilling and byproduct removal system according to claim 6, wherein the container is removably attached to the front portion of the basin.

8. The combination grilling and byproduct removal system according to claim 4, wherein the basin includes a funnel portion and the bottom surface of the basin slopes towards the funnel portion.

9. The combination grilling and byproduct removal system according to claim 8, further comprising: an auxiliary heating element, located adjacent the bottom portion of said oven cavity, for vaporizing at least a portion of the liquid byproducts, thereby producing at least some of the grilling byproducts.

10. The combination grilling and byproduct removal system according to claim 9, wherein the auxiliary heating element is located concentrically within the at least one heating element.

11. In a cooking appliance including an oven cavity having an open frontal portion, a door for selectively sealing the open frontal portion, at least one heating element disposed adjacent a bottom portion of said oven cavity and controls for regulating an activation state of said heating element, a combination grilling and byproduct removal system comprising:

a grilling platform mounted within said oven cavity, said grilling platform including a rack for supporting food items to be grilled and an additional heating element arranged below the rack, said additional heating element being selectively actuatable for grilling food items on the rack;

means, located adjacent the bottom portion of said oven cavity, for vaporizing at least a portion of liquid byproducts, developed in the oven cavity during a grilling operation, into grilling byproducts; and an exhaust system having an inlet opening into the oven cavity and an outlet leading from the oven cavity, said exhaust system including a fan for drawing the grilling byproducts out of the oven cavity.

12. The combination grilling and byproduct removal system according to claim 11, wherein said vaporizing means comprises an auxiliary heating element.

13. The combination grilling and byproduct removal system according to claim 12, wherein the auxiliary heating element is located concentrically within the at least one heating element.

14. The combination grilling and byproduct removal system according to claim 11, wherein the grilling platform further includes a basin arranged below the rack, said basin being adapted to catch the liquid byproducts generated during grilling.

15. The combination grilling and byproduct removal system according to claim 14, wherein the rack is directly supported by the basin.

16. The combination grilling and byproduct removal system according to claim 15, wherein the basin is formed with at least one upper ledge portion, said rack being positioned upon said ledge portion.

17. The combination grilling and byproduct removal system according to claim 14, wherein said basin includes a bottom surface which slopes relative to a horizontal.

18. The combination grilling and byproduct removal system according to claim 17, wherein the bottom surface of the basin slopes downwardly from a rear portion of the basin towards a front portion of the basin.

19. The combination grilling and byproduct removal system according to claim 18, further comprising: a liquid byproduct collection container attached to the bottom surface of the basin.

20. The combination grilling and byproduct removal system according to claim 19, wherein the container is removably attached to the front portion of the basin.

21. The combination grilling and byproduct removal system according to claim 17, wherein the basin includes a funnel portion and the bottom surface of the basin slopes towards the funnel portion.

22. A method of grilling food in an oven cavity provided with at least one selectively actualable heating element comprising:

supporting a food item upon a rack, provided as part of a grilling platform, within the oven cavity;

operating an additional heating element, also provided as part of the grilling platform and arranged beneath the rack, to effectuate grilling of the food item, while developing liquid and gaseous byproducts;

vaporizing at least a portion of the liquid byproducts into gaseous byproducts; and operating an oven cavity exhaust system to remove the gaseous byproducts.

23. The method according to claim 22, further comprising: operating an auxiliary heating element in a lower portion of the oven cavity to vaporize the portion of the liquid byproducts.

24. The method according to claim 23, further comprising: directing the liquid byproducts to the auxiliary heating element.

25. The method according to claim 22, further comprising:

collecting a portion of the liquid byproducts in a container of the grilling platform suspended below the rack.

26. The method according to claim 25, further comprising:

positioning a basin below the rack; and directing the portion of the liquid byproducts to the container along a sloping bottom surface of the basin.

27. The method according to claim 26, further comprising: detachably securing the container to the basin.

28. The method according to claim 26, further comprising:

supporting the rack upon an upper portion of the basin; and operating the additional heating element from between the rack and the bottom surface of the basin.

* * * * *